US005634528A

United States Patent [19]

Watts et al.

[11] Patent Number: 5,634,528

[45] Date of Patent: Jun. 3, 1997

[54] MOBILE WORK STATION

[75] Inventors: William M. Watts; Wilf Vaillancourt, both of Sault Ste. Marie, Canada

[73] Assignee: Bridge Vail International Inc., Canada

[21] Appl. No.: 498,025

[22] Filed: Jul. 3, 1995

[51] Int. Cl.[6] ..... E04G 3/10

[52] U.S. Cl. ..... 182/63; 182/138; 182/36; 182/37; 182/150

[58] Field of Search ..... 182/63, 150, 36, 182/138, 129, 37, 142

[56] References Cited

U.S. PATENT DOCUMENTS

| | | | |
|---|---|---|---|
| 3,550,723 | 12/1970 | Gentry | 182/150 |
| 4,201,275 | 5/1980 | Sinclair et al. | 182/37 |
| 4,811,819 | 3/1989 | Sugiyama | 182/138 |
| 4,848,516 | 7/1989 | Nakai et al. | 182/36 |
| 4,854,419 | 8/1989 | Lyras et al. | 182/129 |
| 4,855,966 | 8/1989 | Cinquino | 367/99 |
| 4,979,589 | 12/1990 | Sugiyama et al. | 182/38 |
| 5,011,710 | 4/1991 | Harrison | 427/142 |
| 5,299,655 | 4/1994 | Margaritis | 182/150 |
| 5,417,301 | 5/1995 | Wildner | 182/63 |

FOREIGN PATENT DOCUMENTS

| | | |
|---|---|---|
| 3214290 | 10/1983 | Germany . |
| 241 626 | 12/1986 | Germany . |
| 245 132 | 4/1987 | Germany . |
| 63-16074 | 1/1988 | Japan . |
| 1100008 | 6/1984 | U.S.S.R. . |
| 1391726 | 4/1988 | U.S.S.R. . |
| 1414759 | 8/1988 | U.S.S.R. . |

*Primary Examiner*—Alvin C. Chin-Shue
*Attorney, Agent, or Firm*—Vanophem Meehan & Vanophem

[57] ABSTRACT

A work station is disclosed comprising: an envelope (20) having a top section (30), a bottom section (31), first (32) and second (33) end sections, and first (34) and second (35) side sections to shelter workers and to contain debris, each section being suspended between a supply means and a take-up means on a plurality of support means (63) about a structure that are mounted in a first motive means (21) on the structure to permit the envelope to be repositioned from time to time, scaffolding means (80–81) suspended by cables on a second motive means to permit a vertical degree of freedom and on a third motive means on a transverse beam (84) for a lateral degree of freedom, each beam being mounted on a fourth motive means on the support means to permit a longitudinal degree of freedom of movement.

13 Claims, 9 Drawing Sheets

MOBILE WORK STATION

FIELD OF THE INVENTION

This invention relates to apparatus adapted to envelop successive portions of a bridge or other structure. The envelope provides a work station to shelter and support workers and equipment during maintenance or construction to minimize the environmental impact of such work. More particularly, the invention relates to a structure for maintaining an envelope about a portion of a bridge, motive means for positioning the envelope from time to time and scaffolding apparatus for supporting workers and equipment within the envelope.

BACKGROUND OF THE INVENTION

It is known that routine maintenance of structures is necessary to prevent them from deteriorating to a point where they must be replaced rather than repaired. Bridges, in particular, require such routine maintenance but many are in extremely poor condition. Many bridges have been closed and torn down because they are unfit for safe passage. Replacement of bridges is expensive and wasteful. Routine repair is a more economical and sensible approach.

There are two fundamental impediments to conducting routine bridge maintenance. It is difficult to put men and equipment up in the air on a large bridge structure where they are exposed to the weather without risking their safety and without interrupting traffic. It is also difficult to ensure that the detritus from cleaning, scraping and painting will not contaminate soil and water surrounding the bridge. As a result bridge maintenance is often postponed or avoided and deterioration continues. The prior art discloses some equipment and methods relating to bridge maintenance but the problem of deteriorating bridges continues.

U.S. Pat. No. 5,011,710 entitled "BRIDGE MAINTENANCE METHOD AND EQUIPMENT" dated Apr. 30, 1991, describes a method in which surfaces of a structure are treated from a walkway within an enclosure suspended from the structure. The enclosure has a downwardly-converging cross section terminating in a vacuum conveyor for collecting and removing particles accumulating from the blasting process. The enclosure is preferably provided in modules. The vacuum conveyor removes the particulate material for transfer to conventional separating and re-cycling equipment. The enclosure and walkway are movably suspended from transverse guides secured to the structure. Similarly, U.S. Pat. No. 4,854,419 entitled "PARTICULATE CONTAINMENT CONTROL METHOD AND PLATFORM DEVICE" dated Aug. 08, 1989, describes a mobile containment platform method and system for sandblasting and the like used in bridge reconditioning and painting that requires removal of paint from the support structure of the bridge. The containment platform provides an entrapment envelop for spent abrasive and removed paint residue.

U.S. Pat. No. 4,201,275 entitled "MEANS FOR THE RENOVATING AND REFURBISHING OF OVERHEAD STRUCTURES" dated May 06, 1980, describes a method for furbishing or renovating large span overhead structures, for example the roofs of railway stations, or bridges and the like. It utilizes apparatus which comprises a plurality of runway beams suspended in spaced parallel disposition from the main ribs or framework of an overhead structure, the beams spanning a plurality of said ribs or framework and being longitudinally displaceable relative thereto, and a work platform or platforms suspended from said runway beams and being displaceable along the runway beams. Thus arranged, the overhead structure can be treated for substantially its entire length by alternately advancing the work platforms along the runway beams and the runway beams relative to the structure.

U.S. Pat. No. 4,848,516 entitled "MOVABLE SCAFFOLD" dated Jul. 18, 1989, describes a movable scaffold has a pair of hanger rails attached to a construction, first hanger units movably mounted on the hanger rails, beams operatively engaged with the first hanger units and laterally disposed with respect to the hanger rails, and a floor deck mounted on the beams. Second hanger units are provided for movably suspending the beams from the first hanger units.

German patent DD 241626 dated Dec. 17, 1986, describes an apparatus to enable a bridge to be painted without erecting a complete scaffold, and enabling road and rail traffic to continue to use the bridge. A roller grid is used, which can be slid the whole length of the bridge. It has an upper frame with a fixed wheel and a lower frame supported by a fixed roller on the bridge structure and attached to the upper frame.

SUMMARY OF THE INVENTION

It is an object of the present invention to contain the debris from maintenance for protection of the environment and to shelter workers from the weather. It is a further object, in the case of bridge structures, to allow for the passage and protection of bridge traffic during maintenance, to provide scaffolding means to position workers and equipment close to all bridge surfaces to be maintained and to provide a movable envelope which can traverse a bridge structure as work progresses. It is a further object of this invention to provide a light, mobile enclosure.

In general, the work station of this invention is an envelope having a top section, a bottom section, first and second end sections, and first and second side sections. Each section is constructed of a material suitable to shelter workers and to contain debris during bridge maintenance and is suspended between a supply means and a take-up means. A plurality of support means suspend the supply means and take up means for the envelope sections about the bridge sufficiently spaced from the sides, top and bottom of the bridge to permit workers to work all about it. The support means is mounted in a motive means mounted on the bridge to permit the envelope to be repositioned from time to time along the length of the bridge. Within the envelope, scaffolding means to support workers in close proximity to bridge surfaces is suspended by cables connected to a second motive means to permit a vertical degree of freedom. The cables are mounted on one or more transverse beams for a lateral degree of freedom. The beams are mounted on a third motive means on the support means to permit a longitudinal degree of freedom of movement.

A passage is formed within the envelope to permit the passage of traffic during maintenance operations. The passage is erected with materials and construction methods that will ensure protection to vehicles from falling debris. Appropriate safety nets may be included to stop heavy objects or tools or falling workmen.

Debris collected within the envelope may be removed by forced fluid or gravity flow from the bottom of the enclosure through a duct to suitable disposal means.

The envelope is also designed to be quickly disassembled in the case of severe weather.

DESCRIPTION OF THE FIGURES

In the Figures that illustrate preferred embodiments of this invention.

DESCRIPTION OF THE INVENTION

Figure 1:
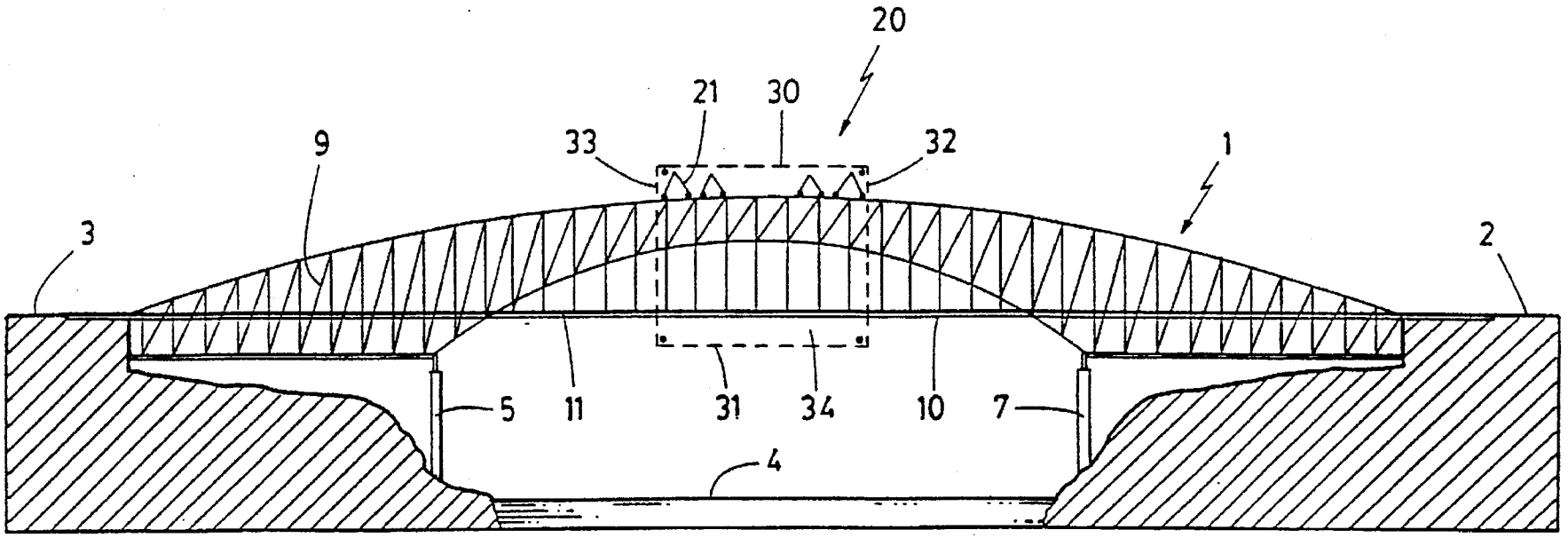
FIG. 1 depicts a bridge enshrouded by the envelope of this invention.

FIG. 1 shows a typical bridge 1 spanning from a north bank 2 to a south bank 3 over a river 4 supported on four pillars 5 and 6 (not shown) on the south side and 7 and 8 (not shown) on the north side. The bridge 1 has a truss structure 9 comprising steel girders an/or cables. Typically there will be an under structure 10 comprising further steel girders which supports a deck 11 and connect to the truss structure 9. Automobile traffic crosses the bridge on the deck 11. These bridge elements will normally be fabricated from steel and concrete and will deteriorate under atmospheric conditions over time.

The repair and maintenance envelope 20 of this invention surrounds a portion of the bridge 1 to protect workers and traffic and to contain debris from the maintenance work from contaminating the river 4 or the river banks 2 and 3. The envelope 20 is able to change location on the bridge 1 by means of a plurality of motive means 21 which ride on a surface of the bridge 1 during movement and may be locked in place during work. It will be seen in other figures that motive means is also provided for moving scaffolding within the envelope 20 during work. The envelope 20 is formed by a plurality of shrouds (top 30, bottom 31, north end 32, south end 33, east side 34 and west side 35) which are mounted on corresponding rollers (top north 40 and top south 40', bottom north 41 and bottom south 41', north end top 42 and north end bottom 42', south end top 43 and south end bottom 43', east side top 44 and east side bottom 44', west side top 45 and west side bottom 45') [not identified in FIG. 1—see other figures].

Figure 2:
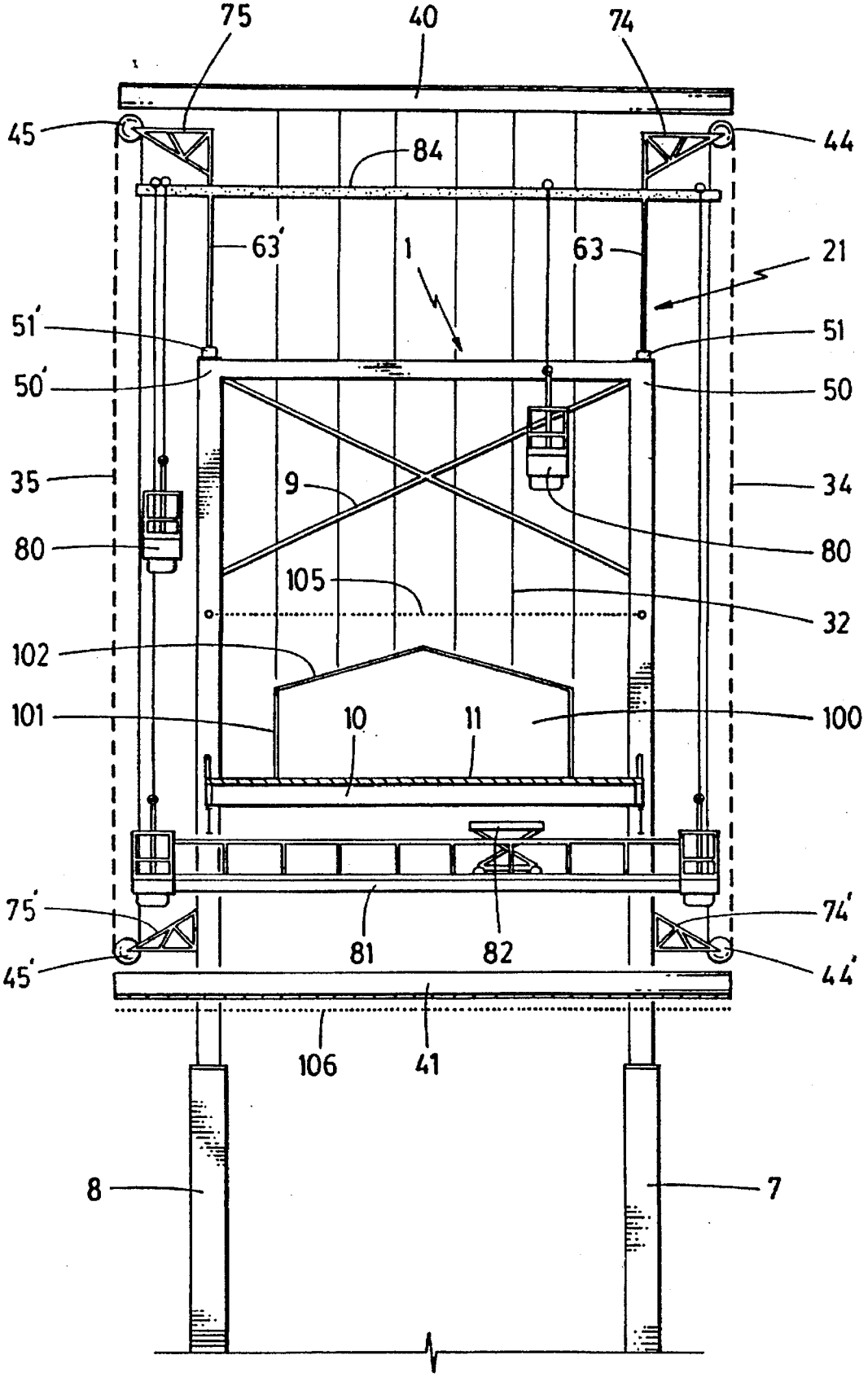
FIG. 2 depicts an embodiment of this invention having overhead motive means viewed from within the envelope looking down the length of the bridge.
Figure 3:
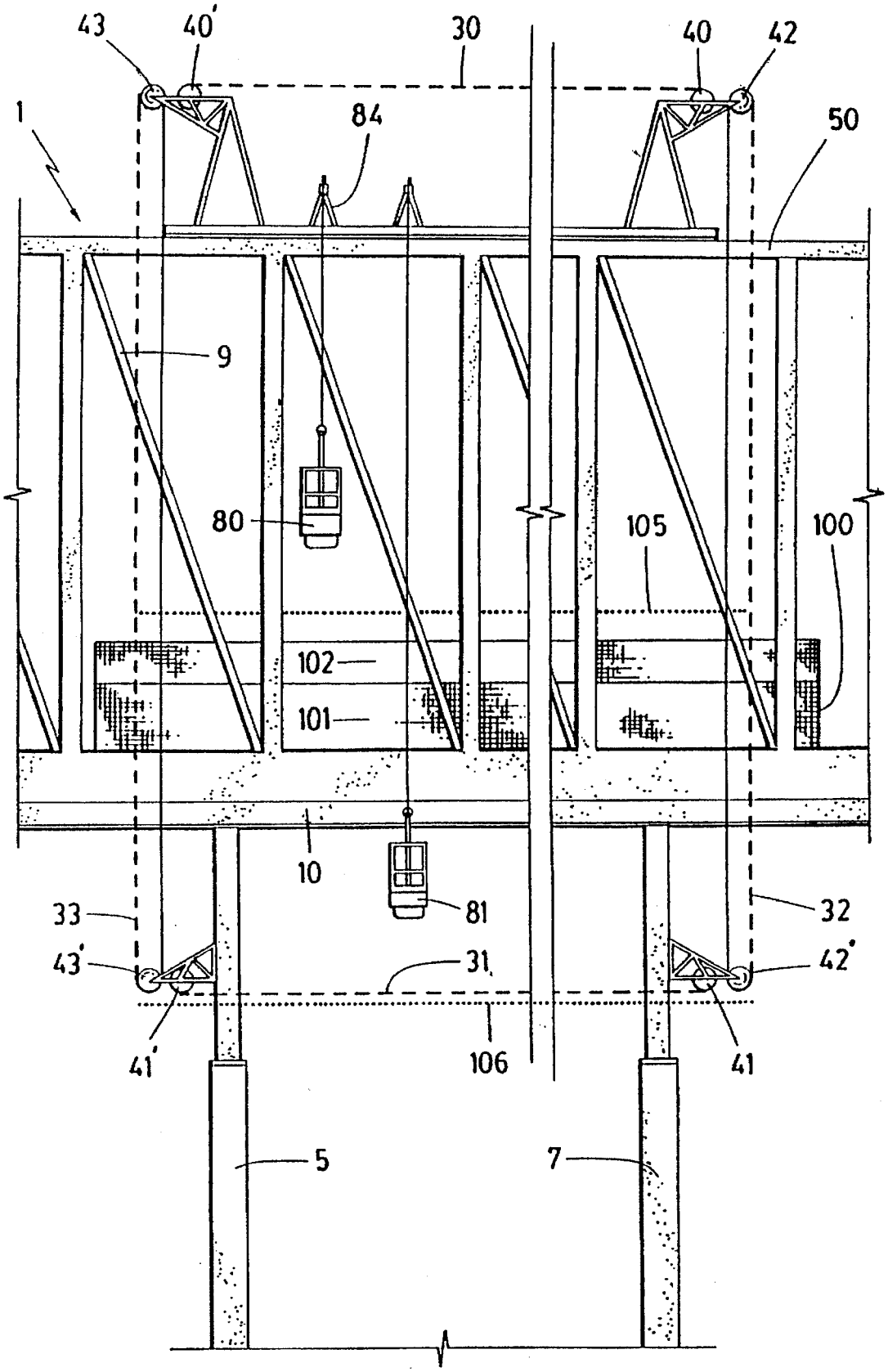
FIG. 3 depicts the embodiment of FIG. 2 from a side cross sectional view of within the envelope.

FIGS. 2 and 3 provide greater detail about the preferred embodiment in which the motive means 21 for the envelope 20 is mounted overhead on the top east girder 50 and top west girder 50' of the bridge 1. Tracks 51 and 51' are positioned on the girders 50 and 50' respectively and fastened temporarily in place. It will be appreciated that the construction of the motive means on the bridge will be within the skill of the art and may assume a number of different forms without departing from the scope of the invention.

Figure 6:
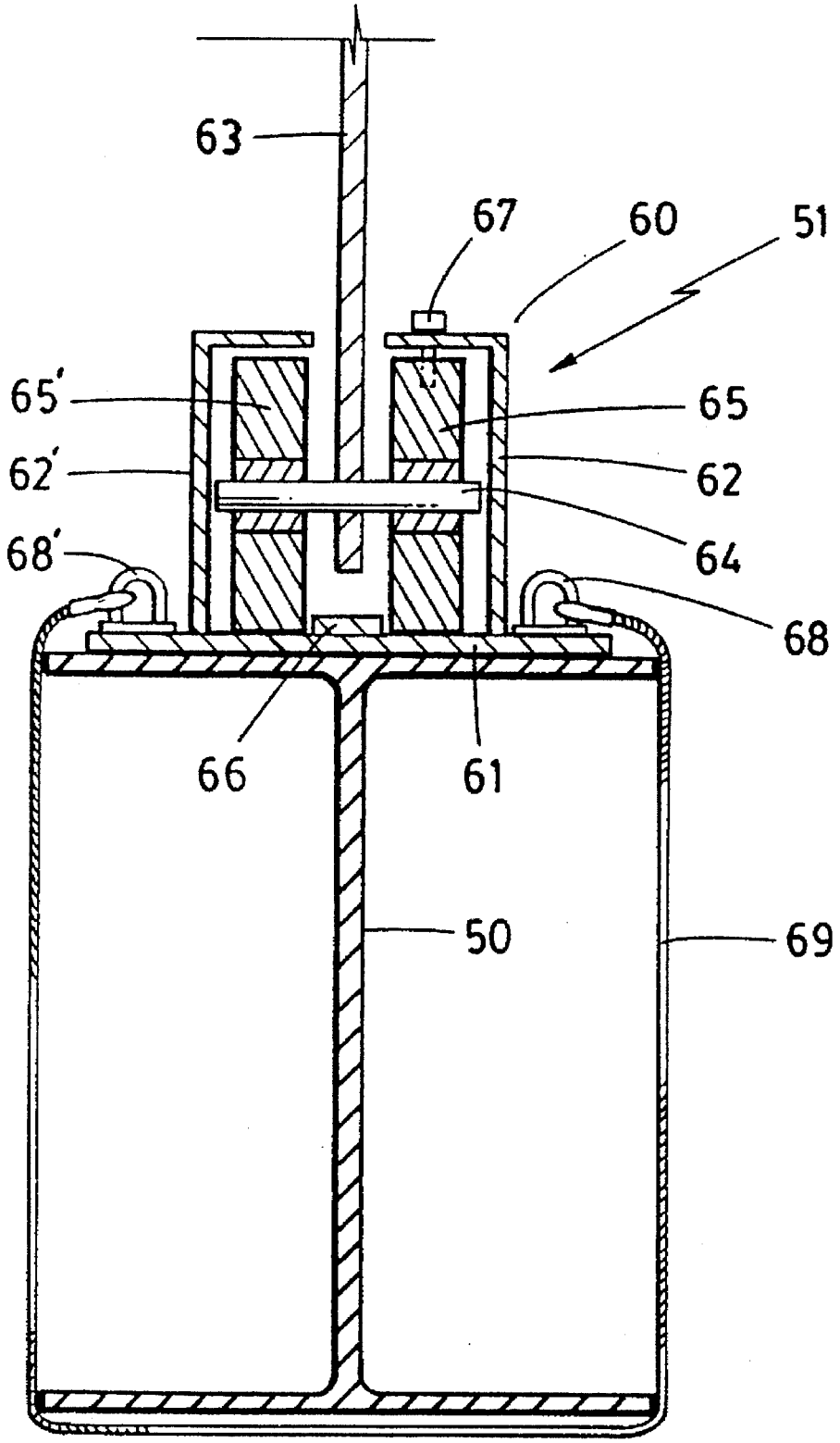
FIG. 6 depicts a moveable rail structure of the motive means.

One such form is shown in FIG. 6 in which the track means 51 comprises a slotted box beam 60 fabricate from a base plate 61 and two upward and inward flanges 62 and 62'. Within the slotted box beam 60, a post 63 moves along the slot on an axle 64 mounted in wheels 65 and 65'. A guide 66 is provided between the wheels 65 and 65' to maintain alignment within the box beam 60. A locking bolt 67 is provided to fix the location of the wheels 65 and 65' within the box beam 60. It will be appreciated that such a box beam 60 could be permanently welded or otherwise fastened in place. In the preferred embodiment of FIG. 6 the box beam 60 may be fastened and unfastened to the girder 50 so that new box beams 60 may be placed down as the envelope advances while those which have been passed over may be taken up and moved forward to a new position. Anchor means 68 and 68' are provided on the base plate 61 to receive a cable or chain 69 which may be looped about the girder 50 and drawn tight to secure the box beam 60 temporarily in place. Protective means for the girder 50 and tightening means are not shown and are within the art.

Returning then to FIGS. 2 and 3 it will be seen that roller 44 which carries shroud 34 is mounted on an outrigger structure 74. It will be appreciated that similar outrigger structures 70, 70' 71, 71' 72, 72' 73, 73', 74, 74', 75 and 75' are provided for the ends of respective rollers 30, 31,32, 33, 34 and 35 with suitable adaptations for their location and function. The outrigger structures can be combined to support more than one roller (see FIG. 3) but the details of the construction of the outriggers is within the art and will not be discussed at length. The rollers identified as top north 40, top south 40', north end top 42, south end top 43, east side top 44 and west side top 45 will have outrigger structures supported on posts similar to post 63 of FIG. 6 which connect into the track means 51 and 51' on the bridge girders 50 and 50'. Each of the rollers is spaced sufficiently from the top bottom and sides of the bridge to permit workers to access their outside surfaces.

The workers are supported within the envelope 20 in scaffolding means including cages 80, platforms 81 and on elevators 82. The cages 80 are supported to move vertically on cables 83 which in turn are connected to move horizontally across beams 84 in response to controls within the cage. As shown in FIG. 3, the beams 84 may be mounted to move horizontally along the length of the envelope. Mechanisms for obtaining such vertical and horizontal movement of the cages 80 are known and will not be discussed here in detail. In the preferred embodiment vertical movement would be obtained with powered pulleys and horizontal movement with a track and wheel means erected over a beam 84 and on the bridge that would be similar in structure to that shown in FIG. 6. Control within the cage would be obtained by known electronic control means and servo motors. The platforms 81 are similarly mounted for vertical and horizontal movement (although in one direction) to position workers under the bridge. More locally, workers can erect elevators 82 on a platform 81 to deal with irregular features of the under structure 10.

Figure 7:
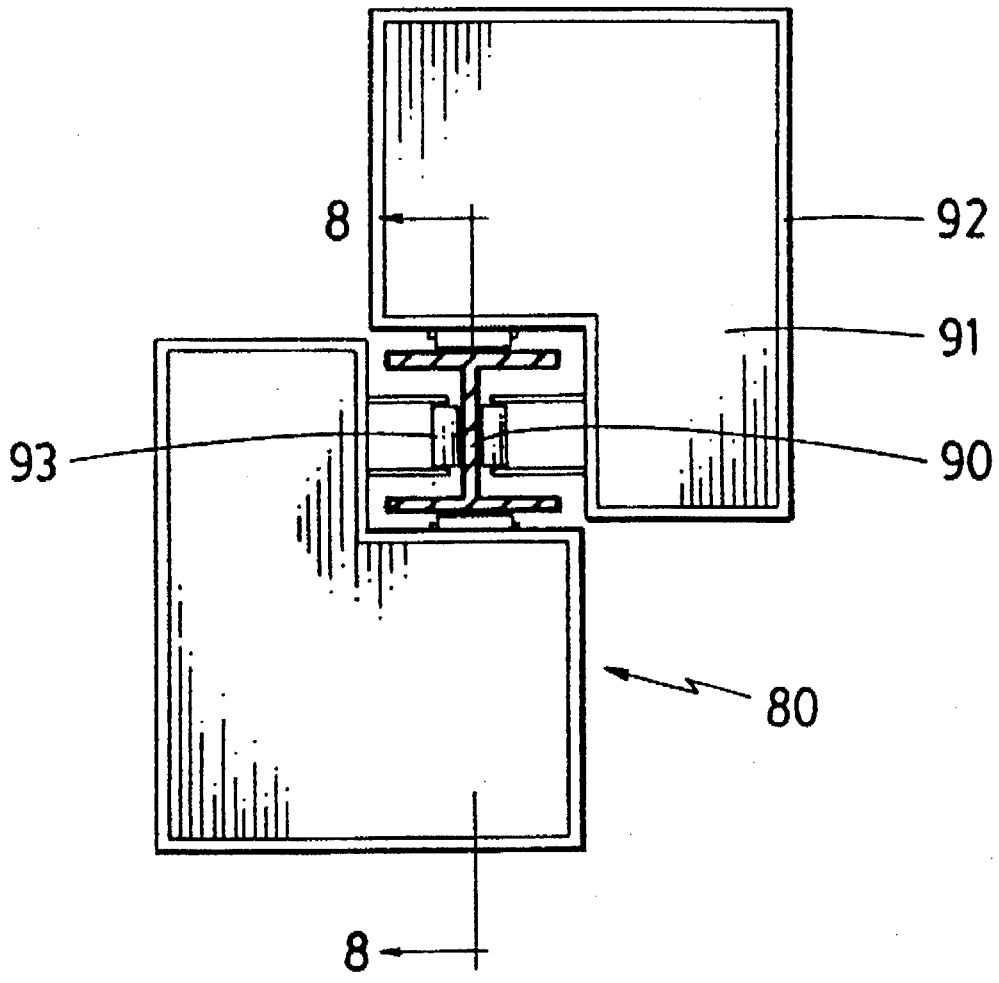
FIG. 7 depicts scaffolding to surround a pillar.
Figure 8:
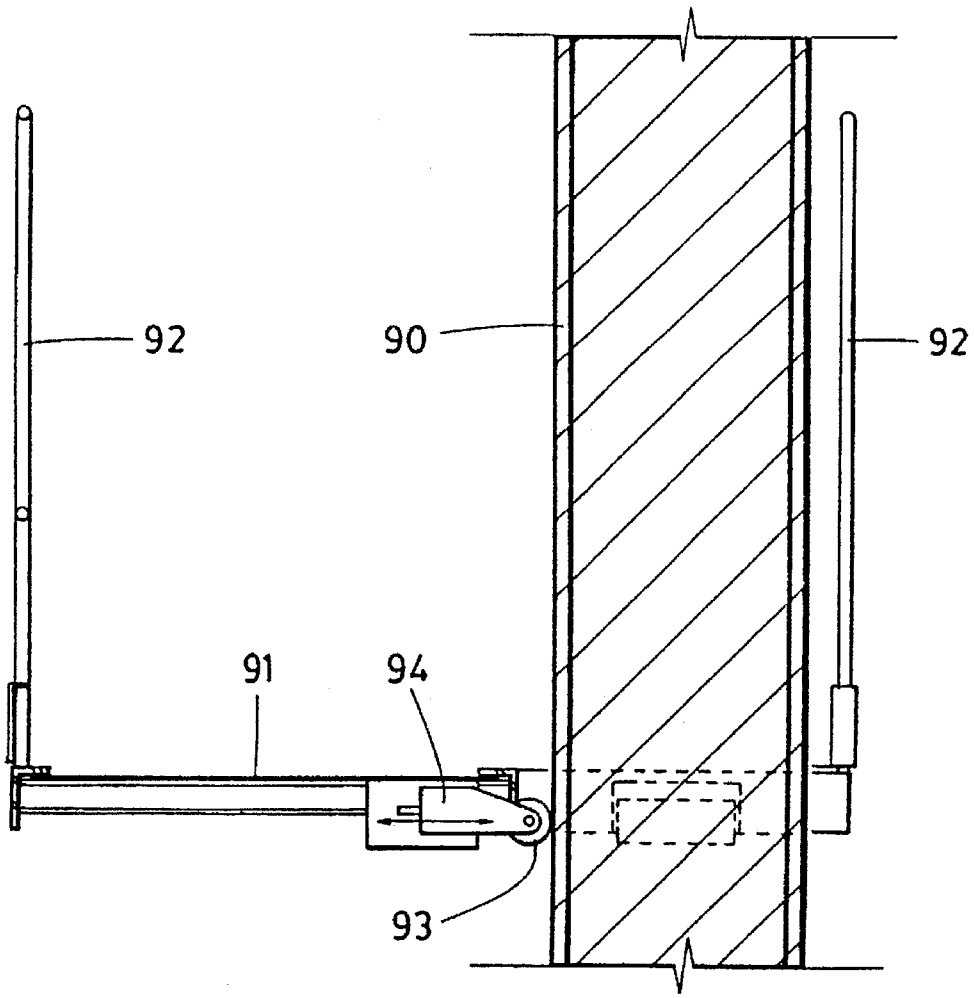
FIG. 8 depicts a scaffolding roller assembly.

FIGS. 7 and 8 illustrate the novel cages 80 which are designed to obtain access to all sides of a girder. The floor plan of each cage 80 has cutout to fit about two vertical faces of a girder 90, (which may be rectangular or in the shape of an I-beam). A worker in the cage 80 is thus positioned to do maintenance work at close range on the surface of the girder 90. As shown in FIG. 8, the distance from the girder 90 is determined and controlled by a positioning arm 91 fastened to the cage 80 by vertical arm 92. The positioning arm 91 terminates at a roller 93 which rides against the girder 90 to maintain rolling contact with the girder 90. A spring/damper unit 94 absorbs dynamic loading.

Figure 4:
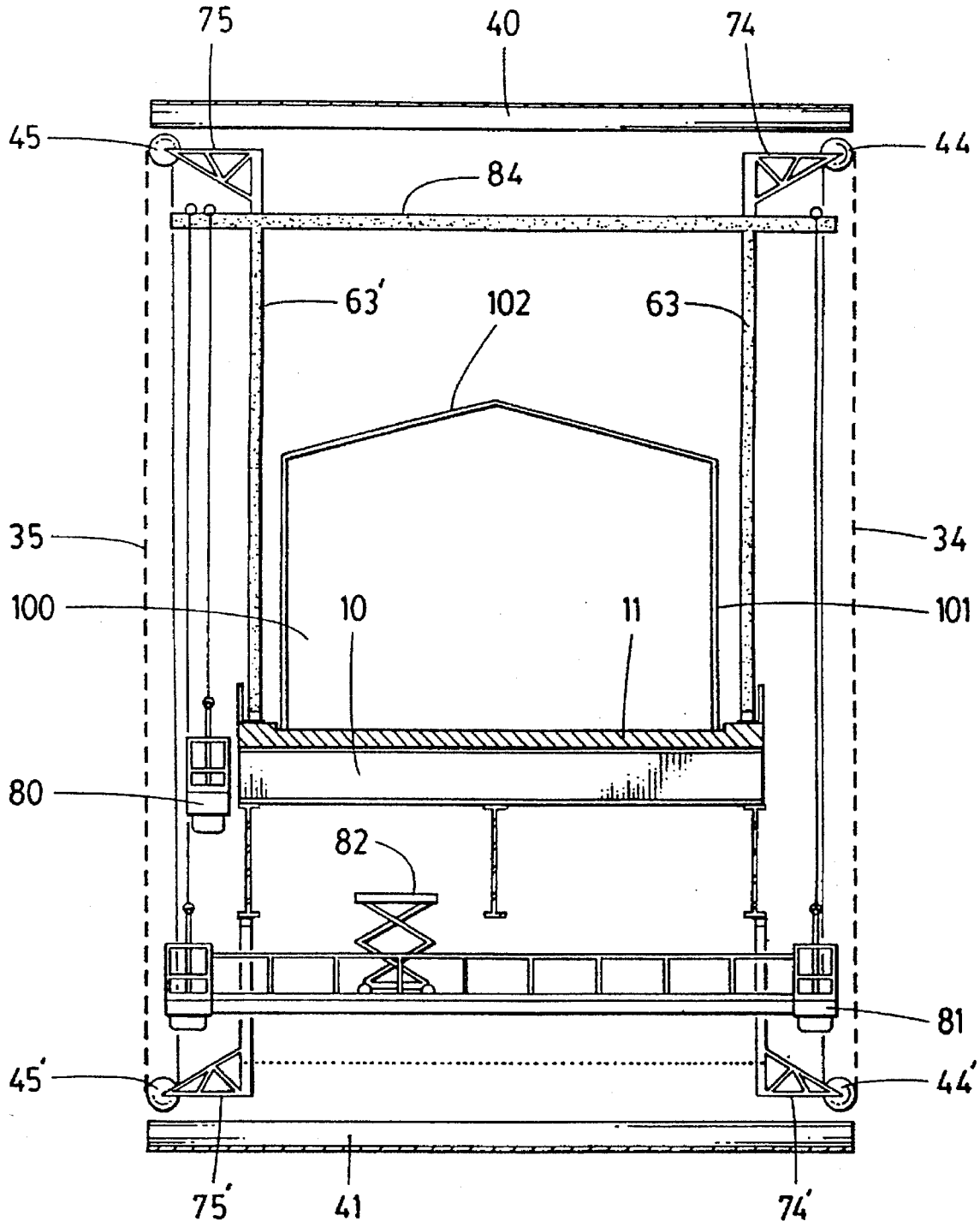
FIG. 4 depicts an embodiment of this invention having motive means mounted on a bridge deck viewed from within the envelope looking down the length of the bridge.
Figure 5:
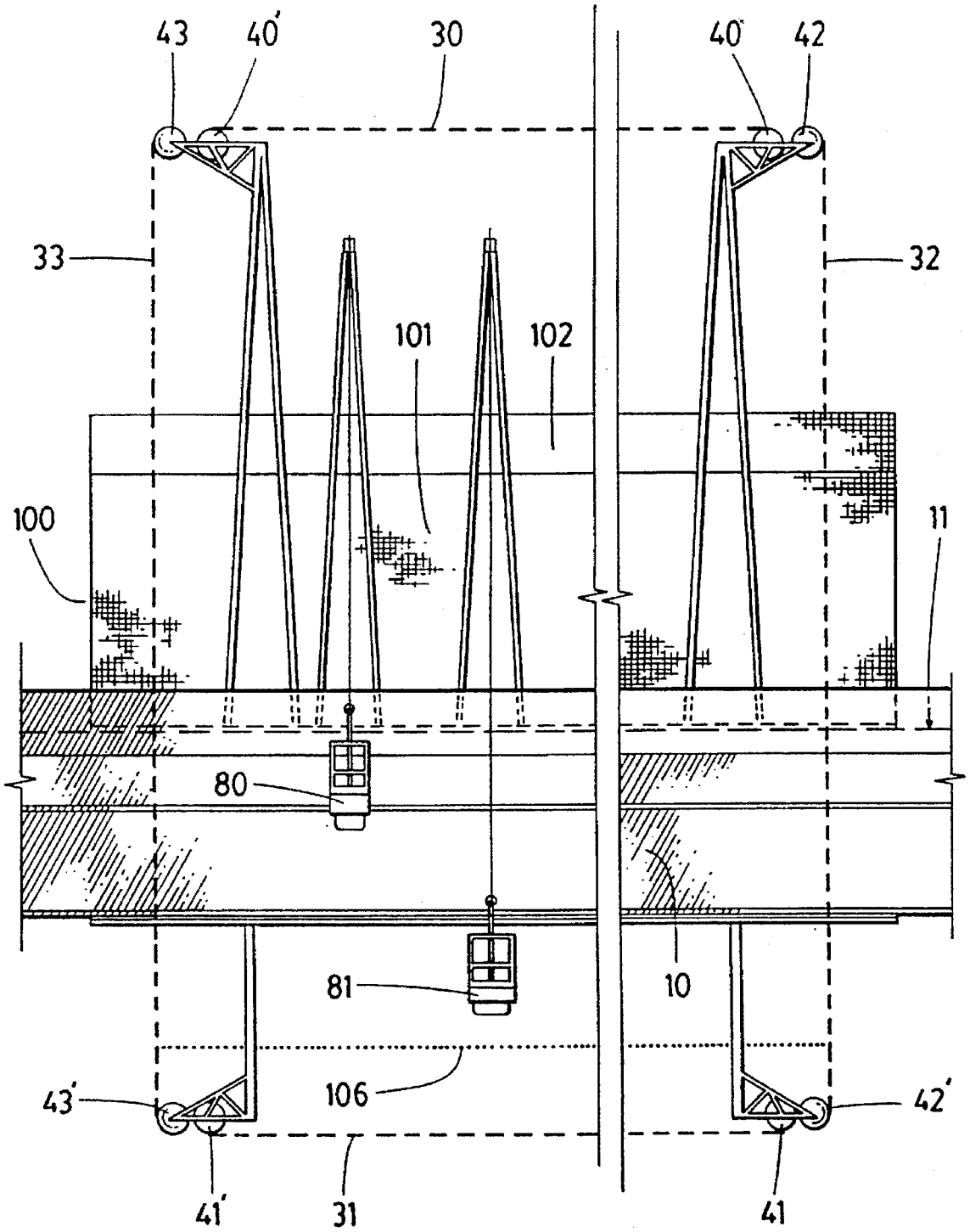
FIG. 5 depicts the embodiment of FIG. 4 from a side cross sectional view of within the envelope.

A second embodiment of this invention is illustrated in FIGS. 4 and 5 in which the shroud rollers are mounted overhead from supporting structures on the bridge deck 11 in motive means 21 constructed in the same manner as described earlier for the top of the bridge 1 and as shown in FIG. 6. Similarly, the beams 84 are mounted to move along the length on the envelope in tracks on the deck 11. In one form of this embodiment the track means for the cages 80, the platforms 81 and the rollers is the same slotted box beam 60. In other forms, the track means 51 will comprise a plurality of parallel box beams or like means, each carrying different equipment to permit equipment to pass other equipment on a different track within the envelope.

A passage 100 for vehicular traffic on the deck 11 is provided in each of the above embodiments. The passage 100 is erected on the deck 11 with walls 101 and a roof 102 of materials and with a construction suitable to deflect any anticipated debris from traffic in the passage. The nature of the materials and construction will be determined by the nature of the work and is within the skill of the art. The walls 101 of the passage 100 may be mounted on the deck in a manner which permits them to be moved from time to time as the envelope 20 advances across the bridge 1.

A safety net 105 may be provided above the passage 100 across the width of the envelope 20 to catch falling objects or workers. Similarly, a safety net 106 may be provided under the bridge.

Figure 9:
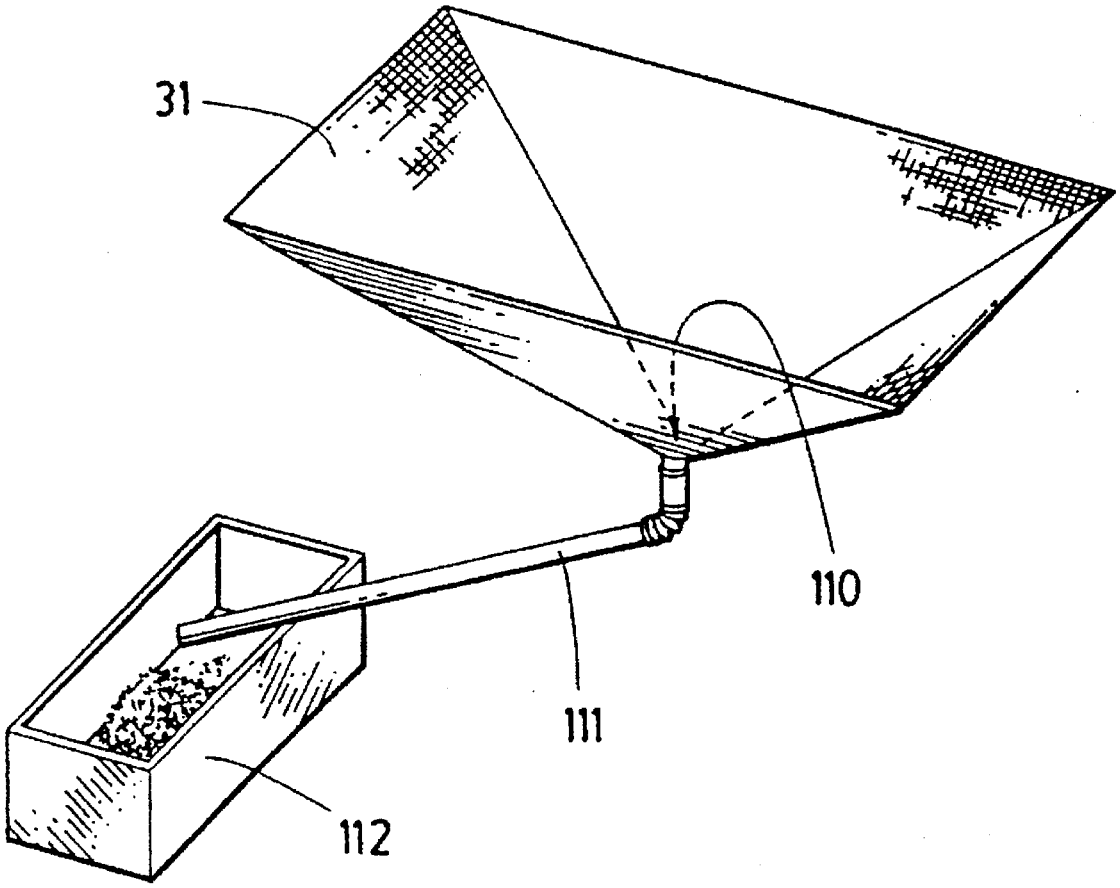
FIG. 9 depicts a duct in the bottom of the envelope to carry off debris.

As illustrated in FIG. 9, a duct 110 may be provided in the bottom section 31 to permit the debris to be removed from the envelope through a pipe 111 to an outside disposal means 112.

It will be appreciated that the preferred embodiments described above are intended to illustrative and not limiting of the construction of this invention. Various other embodiments may be constructed by one skilled in the art, without departing from the principle of this invention, through the use of obvious mechanical equivalents or by arranging the elements of the invention in configurations different from those illustrated in the figures. The invention is more generally defined in the claims which follow.

What is claimed is:

1. A work station comprising:

an envelope (20) having a top section (30), a bottom section (31), first (32) and second (33) end sections, and first (34) and second (35) side sections wherein each said section is constructed of a material suitable to shelter workers and to contain debris, each section being suspended between a supply means and a take-up means (40—40' to 45—45');

a plurality of support means (63) to suspend the supply means and take up means for said sections about a structure, said support means being mounted in a first motive means (21) adapted to be mounted on the structure to permit the envelope to be repositioned from time to time;

scaffolding means (80–81) to support workers within the envelope in close proximity to surfaces of the structure, said scaffolding means being suspended by cables connected to a second motive means to permit a vertical degree of freedom, said cables being mounted on a third motive means on a transverse beam (84) for a lateral degree of freedom and each said beam being mounted on a fourth motive means permit a longitudinal degree of freedom of movement.

2. The work station of claim 1 in which the supply means and the take up means are rollers (44) mounted on a outrigger structure (74).

3. A work station for a bridge comprising:

an envelope (20) having a top section (30), a bottom section (31), first (32) and second (33) end sections, and first (34) and second (35) side sections spaced apart from the bridge by a distance sufficient to permit workers to access all surfaces of the bridge, wherein each said section is constructed of a material suitable to shelter workers and to contain debris, each section being suspended between a supply means and a take-up means (40—40' to 45—45') that permit the sections to be unfuried to construct the envelope or furied to take down the envelope;

a plurality of support means (63) to suspend the supply means and take-up means for said sections about the bridge, said support means being mounted in a first motive means (21) adapted to be mounted on the bridge to permit the envelope to be repositioned from time to time; scaffolding means (80–81) to support workers within the envelope in close proximity to surfaces of the structure, said scaffolding means being suspended by cables connected to a second motive means to permit a vertical degree of freedom, said cables being mounted on a third motive means on a transverse beam (84) for a lateral degree of freedom and each said beam being mounted on a fourth motive means to permit a longitudinal degree of freedom of movement;

a passage from the first end to the second end within the envelope to permit the passage of traffic during maintenance operations.

4. The work station of claim 3 the first motive means comprises tracks (51 and 51') adapted to be positioned on the bridge within the envelope and fastened temporarily in place.

5. The work station of claim 4 in which the tracks (51) comprises a slotted box beam (60) and the support means comprises a post (63) which moves along a slot in the box beam on an axle (64) mounted in wheels (65 and 65') and a guide (66) between the wheels to maintain alignment within the box beam (60) and a locking bolt (67) is provided to fix the location of the wheels (65 and 65') within the box beam (60).

6. The work station of claim 5 in which anchor means (68 and 68') are provided on the tracks to receive a cable (69) looped about a girder (50) and drawn tight to secure the box beam (60) temporarily in place.

7. The work station of claim 3, wherein the scaffold means comprises cages (80), scaffolds (81) and elevator platforms (82) wherein the cages (80) are supported to move vertically by cables (83) which in turn are connected to move horizontally across the beam (84) in response to controls within the cage.

8. The work station of claim 7 in which the beam is mounted to move horizontally by the length of the envelope and the cages are moved along the cables by means of powered pulleys and horizontally along the beam on a track and wheel means erected over the beam, wherein movement of the cage is controlled from within the cage by control means and servo motors.

9. The work station of claim 7 in which the cages (80) have a floor with a cutout to fit about two vertical faces of a girder to position a worker to do maintenance work at close range on the surface of the girder (90).

10. The work station of claim 9 in which the distance from the girder (90) is determined and controlled by a positioning arm (91) fastened to the cage (80) by a vertical arm (92), said positioning arm (91) terminating at a roller (93) for maintaining rolling contact with a bridge surface and having a spring/damper unit (94) to absorb dynamic loading.

11. The work station of claim 3 in which rollers are mounted overhead from the support means on said first motive means (21) and the beams (84) are adapted to be mounted in tracks on the bridge.

12. The work station of claim 3 in which the passage (100) comprise walls (101) and a roof (102) suitable to deflect any anticipated debris and adapted to be mounted on the bridge for longitudinal movement.

13. The work station of claim 3 in which a safety net (105) is provided above the passage to catch falling objects or workers.

* * * * *